US008065998B2

(12) United States Patent
Espina et al.

(10) Patent No.: US 8,065,998 B2
(45) Date of Patent: Nov. 29, 2011

(54) COOKING GRIDDLE AND ASSOCIATED GAS FLOW CONTROL ARRANGEMENT

(75) Inventors: Miguel A. Espina, Matthews, NC (US); Christian M. Yungbluth, Charlotte, NC (US)

(73) Assignee: ITW Food Equipment Group LLC, Troy, OH (US)

( * ) Notice: Subject to any disclaimer, the term of this patent is extended or adjusted under 35 U.S.C. 154(b) by 284 days.

(21) Appl. No.: 12/409,246

(22) Filed: Mar. 23, 2009

(65) Prior Publication Data

US 2009/0235918 A1 Sep. 24, 2009

Related U.S. Application Data

(60) Provisional application No. 61/038,805, filed on Mar. 24, 2008.

(51) Int. Cl.

| | |
|---|---|
| ***F24C 3/12*** | (2006.01) |
| ***F24C 3/00*** | (2006.01) |
| ***F23Q 9/08*** | (2006.01) |
| ***F23Q 9/00*** | (2006.01) |
| ***F23N 5/00*** | (2006.01) |

(52) U.S. Cl. ..... 126/39 G; 126/39 D; 126/39 R; 431/51; 431/52; 431/54; 431/81

(58) Field of Classification Search ..... 126/39 D, 126/39 G, 39 R; 431/54, 52, 51, 81
See application file for complete search history.

(56) References Cited

U.S. PATENT DOCUMENTS

| | | | | |
|---|---|---|---|---|
| 2,562,536 A | | 7/1951 | Mayer | |
| 3,963,414 A | | 6/1976 | Jensen | |
| 3,976,243 A | * | 8/1976 | Christophel | 236/6 |
| 4,067,681 A | | 1/1978 | Reid, Jr. et al. | |
| 4,081,235 A | | 3/1978 | van der Veer | |
| 4,147,496 A | | 4/1979 | Oikawa | |

(Continued)

FOREIGN PATENT DOCUMENTS

| | | |
|---|---|---|
| JP | 55-075128 | 6/1980 |

(Continued)

OTHER PUBLICATIONS

See admitted Prior Art discussed in paragraphs [0003] and [0004] of the specification of the present application.

*Primary Examiner* — Kenneth Rinehart
*Assistant Examiner* — William Corboy
(74) *Attorney, Agent, or Firm* — Thompson Hine LLP

(57) ABSTRACT

A cooking apparatus includes a housing and a cooking plate. Burners are located within the housing and below the cooking plate. A non-powered mechanical thermocouple probe is proximate to a pilot burner with a bi-metal element that produces an electrical signal when heated by the pilot burner. A pilot shutoff valve has an inlet connected to receive gaseous fuel from a gaseous fuel manifold, a pilot output connected to deliver gas to the pilot burner, a main burner output connected to deliver gas the burners, and a thermocouple probe input connected to receive the electrical signal produced by the bi-metal element. The pilot shutoff valve is biased to a default closed position where gas is prevented from flowing from the inlet to the pilot output and from the inlet to the main burner output. When the pilot shutoff valve is open, the pilot shut off valve permits gas to flow from the inlet to the pilot output and from the inlet to the main burner output.

3 Claims, 4 Drawing Sheets

U.S. PATENT DOCUMENTS

| | | | | |
|---|---|---|---|---|
| 4,360,338 | A | 11/1982 | Katchka | |
| 4,437,830 | A | 3/1984 | Harris et al. | |
| 4,887,959 | A | 12/1989 | Shellenberger | |
| 5,271,375 | A | 12/1993 | Ekermans | |
| 5,890,482 | A * | 4/1999 | Farnsworth et al. | 126/39 R |
| 6,050,808 | A | 4/2000 | Schloss | |
| 6,065,484 | A * | 5/2000 | Bartel et al. | 137/66 |
| 2004/0025949 | A1 * | 2/2004 | Wygnaski | 137/624.18 |

FOREIGN PATENT DOCUMENTS

| | | |
|---|---|---|
| JP | 62-292985 | 12/1987 |

* cited by examiner

COOKING GRIDDLE AND ASSOCIATED GAS FLOW CONTROL ARRANGEMENT

TECHNICAL FIELD

This application relates generally to cooking griddles and more particularly to a gas flow control arrangement in a cooking griddle.

BACKGROUND

Griddle apparatus are frequently used in commercial settings for cooking various types of food, such as hamburgers. The griddle apparatus typically includes a main burner for heating the griddle plate and a pilot for facilitating on-demand ignition of the main burner.

In the past, it was known to have a griddle system including a gas manifold feeding both a pilot burner and one or more main griddle burners. A solenoid valve (normally closed) was provided to control flow (OPEN or CLOSED valve state) from the manifold to the pilot burner in accordance with whether an electrical power switch of the griddle apparatus was ON/OFF. A separate, main burner solenoid valve (normally closed) controlled gas flow from the manifold to the griddle burners. The OPEN/CLOSED state of the main burner solenoid was determined by both (i) a detected status of the pilot burner as determined by a pilot probe and (ii) the set point of a thermostat having a probe proximate the griddle plate. Specifically, the pilot probe acted as a normally open switch that closed when a pilot flame was detected. Closure of this pilot probe switch enabled power to be delivered to the main burner solenoid valve if called for by the thermostat. The thermostat operated as a closed switch when the temperature of the thermostat probe was below the thermostat set point. The thermostat switch opened when the temperature of the thermostat probe reached the set point of the thermostat. With both the pilot probe switch closed and the thermostat switch closed, power was delivered to the main burner solenoid to permit gas flow from the manifold to the griddle burners.

In the past, it was also known to use the combination of a non-powered pilot shutoff valve with an associated mechanical, non-powered pilot probe sensor to control the open/closed state of the pilot shutoff valve for the purpose of controlling gas flow to both the pilot burner and a non-powered, modulating type thermostat gas valve feeding the burner arrangement of a range oven chamber.

It would be desirable to provide a griddle gas flow control that does not require powered components.

SUMMARY

In an aspect, a cooking apparatus includes a housing and a cooking plate having an upper cooking surface for receiving food product and an opposite surface for being heated. A first gas burner is located within the housing and below the cooking plate for heating the cooking plate and a second gas burner is located within the housing and below the cooking plate for heating the cooking plate. A pilot burner is located intermediate the first gas burner and the second gas burner for facilitating ignition of the first and second gas burners. A non-powered mechanical thermocouple probe is located proximate the pilot burner and having a bi-metal element that produces an electrical signal when heated by flame from the pilot burner. A pilot shutoff valve has an inlet connected to receive gaseous fuel from a gaseous fuel manifold, a pilot output connected to deliver gas to the pilot burner, a main burner output connected to deliver gas to both the first gas burner and the second gas burner, and a thermocouple probe input connected to receive the electrical signal produced by the bi-metal element of the mechanical thermocouple probe. The pilot shutoff valve is biased to a default closed position in which gas is prevented from flowing both from the inlet to the pilot output and from the inlet to the main burner output. The pilot shutoff valve is held in an open condition when the electrical signal is received from the bi-metal element, the open condition permitting gas to flow both from the inlet to the pilot output and from the inlet to the main burner output. The pilot shutoff valve also has an associated pilot start button biased into a non-start position. When the pilot start button is manually moved to a start position the pilot shutoff valve permits gas to flow from the inlet to the pilot output and prevents gas from flowing from the inlet to the main burner output.

A similar arrangement feeding a single main burner of a griddle or one or more open top burners of a cooking device could also be provided.

The details of one or more embodiments are set forth in the accompanying drawings and the description below. Other features, objects, and advantages will be apparent from the description and drawings, and from the claims.

DETAILED DESCRIPTION

Figure 1:
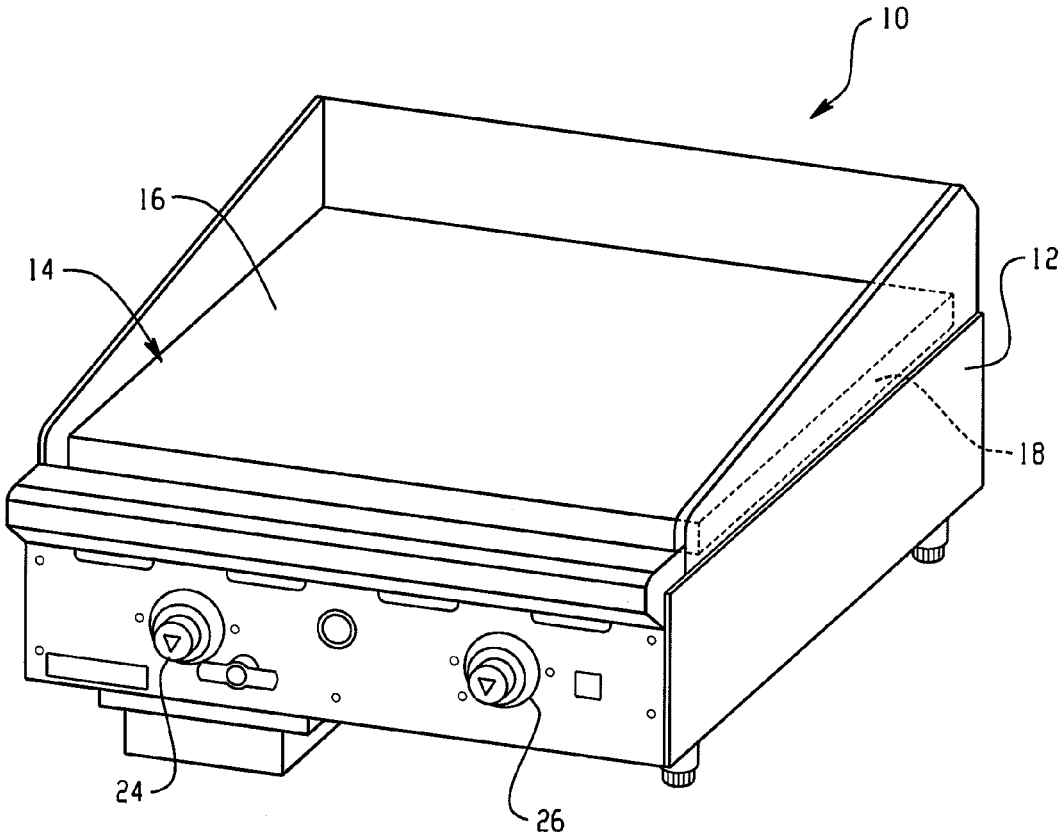
FIG. 1 shows an exemplary griddle apparatus.
Figure 2:
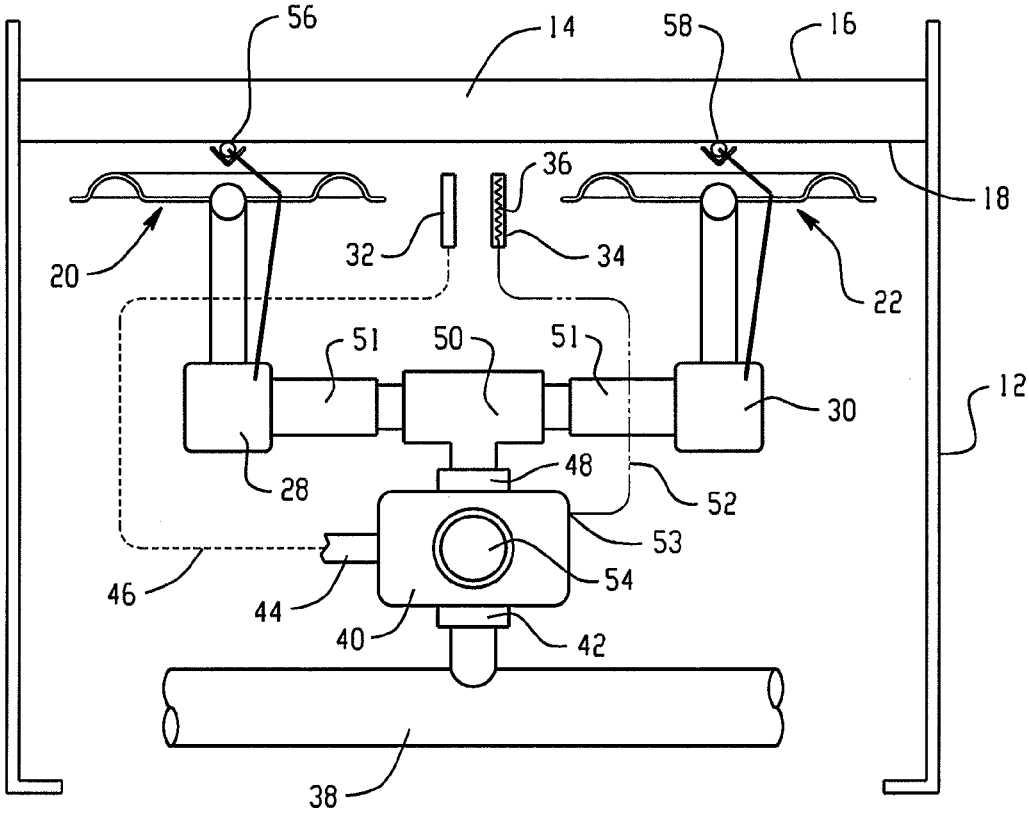
FIG. 2 is a schematic partial depiction of the griddle apparatus of FIG. 1.
Figure 3:
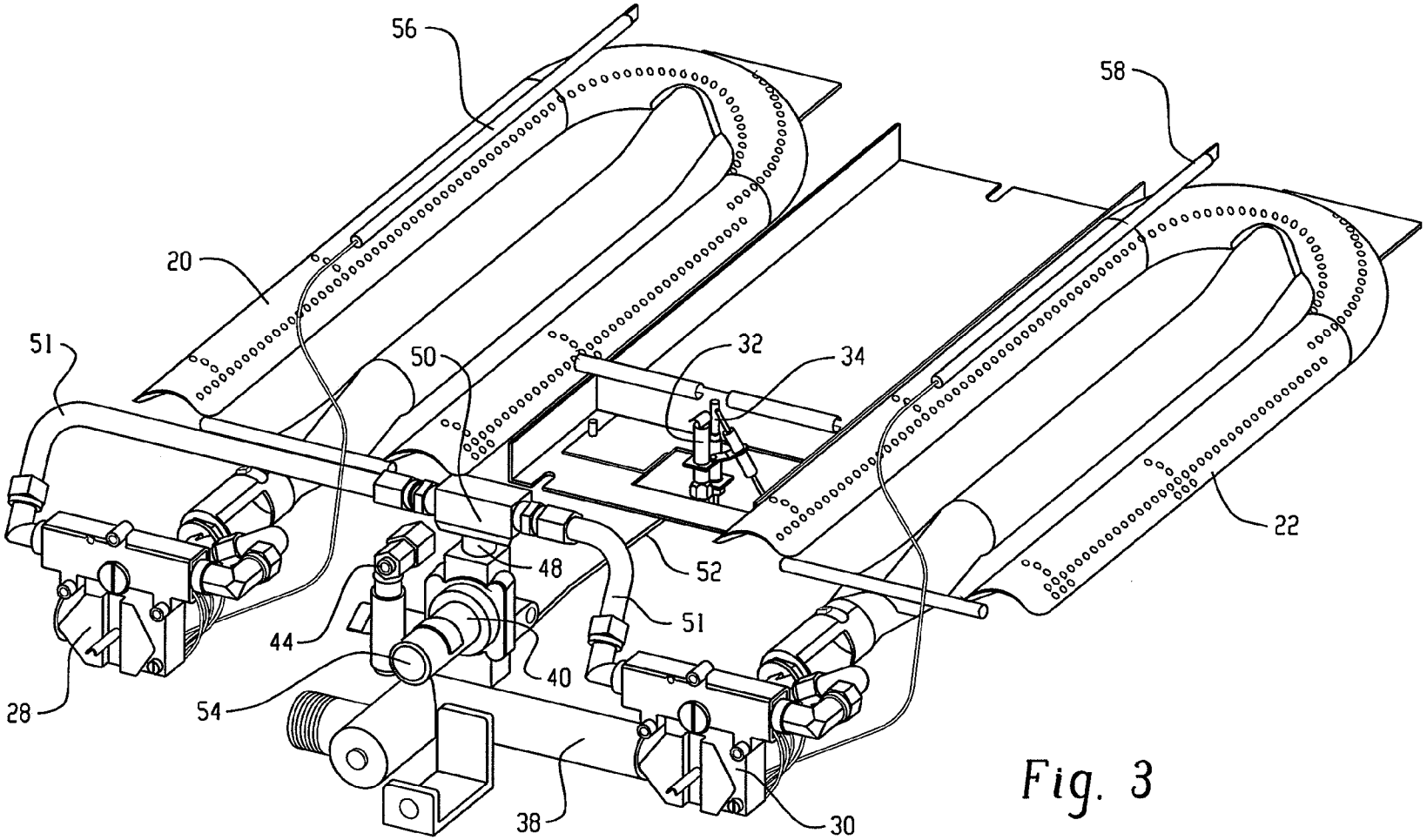
FIG. 3 is a partial perspective view of the burner system of the griddle of FIG. 1.

Referring to FIGS. 1-3, an exemplary cooking apparatus in the form of a griddle 10 is shown. The griddle includes a housing 12 and a cooking plate 14 mounted on the housing. The cooking plate includes an upper cooking surface 16 and an opposite, lower surface 18 that is heated by gaseous fuel burners 20 and 22. The front side of the griddle includes gaseous fuel control knobs 24 and 26 that control the set point of respective non-powered thermostat valves 28 and 30 (e.g., of the snap acting hydraulic type) that feed the burners 20 and 22. A pilot burner 32 is located intermediate the gas burners 20 and 22 for facilitating ignition of the gas burners. A non-powered mechanical thermocouple probe 34 is located proximate the pilot burner 32 and has an internal bi-metal element 36 that produces an electrical signal when heated by flame from the pilot burner.

Gaseous fuel entering the griddle apparatus is delivered via a gaseous fuel manifold 38 to a pilot shutoff valve 40 for subsequent delivery to both the pilot burner 32 and the thermostat valves 28 and 30 that feed the burners 20 and 22. The pilot shutoff valve has an inlet 42 connected to receive gaseous fuel from the gaseous fuel manifold, a pilot output 44 connected to deliver gas to the pilot burner (e.g., via suitable piping, tubing or other structure 46) and a main burner output 48 connected to deliver gas to both of the gas burners 20 and 22 via a T-splitter 50 and tubing 51 that directs gaseous fuel to both of the valves 28 and 30. The pilot shutoff valve 40 also includes a thermocouple probe input 53 connected (e.g., via wiring 52) to receive the electrical signal produced by the bi-metal element 36 of the mechanical thermocouple probe 34.

The pilot shutoff valve may, for example be an H15 Series Automatic Shutoff Pilot Gas Valve available from BASO Gas Products LLC of Watertown, Wis. This valve is biased to a default closed position via a magnet. In the default closed position gas is prevented from flowing both from the inlet 42 to the pilot output 44 and from the inlet 42 to the main burner output 48. The electrical signal (e.g., a millivolt signal) from the bi-metal element 34 counteracts the magnet of the valve to hold the valve in an open condition when the electrical signal is received from the bi-metal element 34. In the open condition the valve permits gas to flow both from the inlet 42 to the pilot output 44 and from the inlet 42 to the main burner output 48. The pilot shutoff valve also has an associated pilot start button 54 biased into a non-start position. When the pilot start button 54 is manually moved to a start position (e.g., it is manually depressed) the pilot shutoff valve permits gas to flow from the inlet 42 to the pilot output 44 and prevents gas from flowing from the inlet 42 to the main burner output 48.

Each thermostat valve 28 and 30 includes a respective temperature probe 56 and 58 located proximate the griddle plate for sensing temperature of the griddle plate. The probes may be shielded from being heated directly by the flame of the burners 20 and 22. The thermostat valves 28 and 30 responsively open/close in response to temperature indicated by the probes, in accordance with the desired or set temperature established by rotation of the valve control knobs 24 and 26. The valves 28 and 30 may be hydraulic bulb type valves.

In operation from a "cold start" (i.e., the pilot burner 32 is not lit and the pilot shutoff valve 40 is in the closed condition), the pilot start button 54 is depressed to allow gas to flow to the pilot burner 32. The pilot burner is then ignited (e.g., as by manual ignition, piezoelectric spark ignition, electric spark ignition or electronic spark ignition). Ignition of the pilot burner will immerse the thermocouple probe in the pilot flame or heat from the pilot flame. The pilot start button 54 is manually held in the depressed position until the thermocouple probe 34 generates a millivolt signal strong enough to keep the pilot shutoff valve in the open condition, at which point the button may be released. Normal operation of the pilot shutoff valve will not allow gas to flow downstream to the main burner outlet 48 until the button 54 is released. Gas may then flow through the downstream gas valves 28 and 30 to the burners 20 and 22 as dictated by the control mechanism of the valves 28 and 30.

If the pilot flame is extinguished and/or no gas combustion is taking place adjacent to the thermocouple probe 34 that is strong enough to maintain the millivolt signal to the pilot shutoff valve, the pilot shutoff valve will move to the (normally) closed position and cease gas flow to all of the downstream gas valves. Once gas flow has ceased, the operator must return to the first step in the cold start process.

Figure 4:
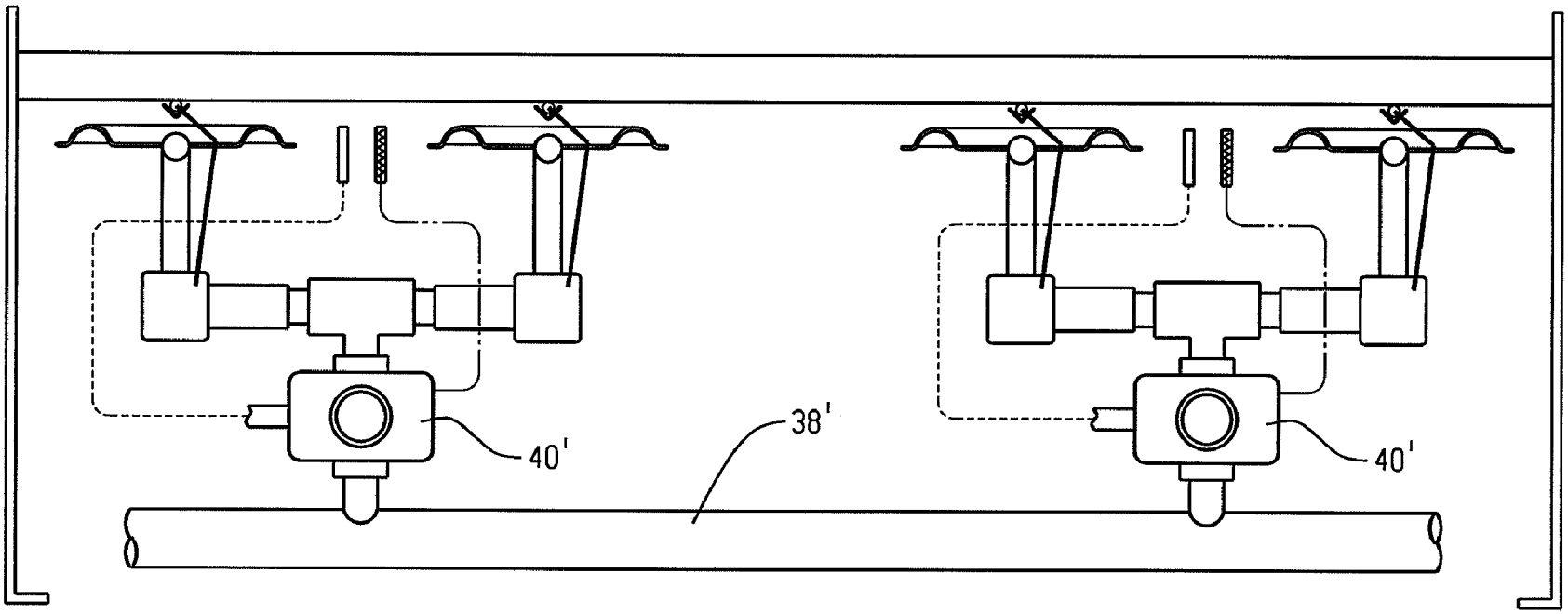
FIG. 4 is a schematic partial depiction of a griddle apparatus including multiple pilot shutoff valves.

A given griddle apparatus may include more than one pilot shutoff valve and associated thermocouple probe, each arranged to feed gas to a respective burner arrangement inclusive of a pilot burner and one or more main burners (e.g., as schematically depicted in FIG. 4 by pilot shutoff valves 40', which are fed by common gas manifold 38').

Use of the above pilot system enables flow to both the pilot burner and main gas burners of a griddle to be turned off in the event that the pilot burner goes out or has not yet been lit.

It is to be clearly understood that the above description is intended by way of illustration and example only and is not intended to be taken by way of limitation, and that changes and modifications are possible. For example, while a griddle apparatus is primarily described, the inventive concepts could be utilized in connection with other cooking plate devices, such as braising pans. Moreover, although a griddle plate with an upwardly facing cooking surface is primarily shown and described, the shielding arrangements could be implemented on a top griddle plate (e.g., the upper griddle plate of a clamshell type griddle having both an upper griddle plate and a lower griddle plate). Moreover, the subject pilot shutoff valve arrangement could be incorporated into a cooking device for feeding an open top burner of the device. Accordingly, other embodiments are contemplated and modifications and changes could be made without departing from the scope of this application.

What is claimed is:

1. A cooking apparatus, comprising:

a housing;

a cooking plate having an upper cooking surface for receiving food product and an opposite surface for being heated;

a first gas burner within the housing and below the cooking plate for heating the cooking plate;

a second gas burner within the housing and below the cooking plate for heating the cooking plate;

a pilot burner located intermediate the first gas burner and the second gas burner for facilitating ignition of the first and second gas burners;

a non-powered mechanical thermocouple probe located proximate the pilot burner and having a bi-metal element that produces an electrical signal when heated by flame from the pilot burner;

a pilot shutoff valve having an inlet connected to receive gaseous fuel from a gaseous fuel manifold, a pilot output connected to deliver gas to the pilot burner, a main burner output connected to deliver gas to both the first gas burner and the second gas burner, and a thermocouple probe input connected to receive the electrical signal produced by the bi-metal element of the mechanical thermocouple probe, the pilot shutoff valve biased to a default closed position in which gas is prevented from flowing both from the inlet to the pilot output and from the inlet to the main burner output, the pilot shutoff valve held in an open condition when the electrical signal is received from the bi-metal element, the open condition permitting gas to flow both from the inlet to the pilot output and from the inlet to the main burner output, the pilot shutoff valve having an associated pilot start button biased into a non-start position, when the pilot start button is manually moved to a start position the pilot shutoff valve permits gas to flow from the inlet to the pilot output and prevents gas from flowing from the inlet to the main burner output;

a first non-powered thermostat valve connected between the main burner output and the first gas burner and having a thermostat for controlling an open/closed condition of the first non-powered thermostat valve in response to sensed temperature; and a second non-powered thermostat valve connected between the main burner output and the second gas burner and having a thermostat for controlling an open/closed condition of the second non-powered thermostat valve in response to sensed temperature;

a third gas burner within the housing and below the cooking plate for heating the cooking plate;

a fourth gas burner within the housing and below the cooking plate for heating the cooking plate;

a second pilot burner located intermediate the third gas burner and the fourth gas burner for facilitating ignition of the third and fourth gas burners;

a second non-powered mechanical thermocouple probe located proximate the second pilot burner and having a bi-metal element that produces an electrical signal when heated by flame from the second pilot burner;

a second pilot shutoff valve having an inlet connected to receive gaseous fuel from the gaseous fuel manifold, a pilot output connected to deliver gas to the second pilot burner, a main burner output connected to deliver gas to both the third gas burner and the fourth gas burner, and a thermocouple probe input connected to receive the electrical signal produced by the bi-metal element of the second mechanical thermocouple probe, the second pilot shutoff valve biased to a default closed position in which gas is prevented from flowing both from the inlet to the pilot output and from the inlet to the main burner output, the second pilot shutoff valve held in an open condition when the electrical signal is received from the bi-metal element of the second mechanical thermocouple probe, the open condition permitting gas to flow both from the inlet to the pilot output and from the inlet to the main burner output, the second pilot shutoff valve having an associated pilot start button biased into a non-start position, when the pilot start button is manually moved to a start position the second pilot shutoff valve permits gas to flow from the inlet to the pilot output and prevents gas from flowing from the inlet to the main burner output.

2. The cooking apparatus of claim 1 wherein the first non-powered thermostat valve is a hydraulic bulb thermostat valve and the second non-powered thermostat valve is a hydraulic bulb thermostat valve.

3. The cooking apparatus of claim 1 wherein the main burner output is connected to a T-splitter that directs gaseous fuel to both the first thermostat valve and the second thermostat valve.

* * * * *